US006412939B1

(12) United States Patent
Schultz et al.

(10) Patent No.: US 6,412,939 B1
(45) Date of Patent: Jul. 2, 2002

(54) METHOD FOR PRINTING ON NON-POROUS SURFACES

(75) Inventors: Matthias Schultz, Hinteregg; Johannes van der Waard, Egg, both of (CH)

(73) Assignee: Pelikan Produktions AG, Egg (CH)

( * ) Notice: Subject to any disclaimer, the term of this patent is extended or adjusted under 35 U.S.C. 154(b) by 0 days.

(21) Appl. No.: 09/644,367

(22) Filed: Aug. 23, 2000

(30) Foreign Application Priority Data

Sep. 1, 1999 (DE) ..... 199 41 673

(51) Int. Cl.[7] ..... B41J 2/01
(52) U.S. Cl. ..... 347/101; 347/100; 347/105
(58) Field of Search ..... 347/100, 96, 101, 347/105, 106; 428/195

(56) References Cited

U.S. PATENT DOCUMENTS 5,317,337 A 5/1994 Ewaldt
5,992,892 A * 11/1999 Schaefer et al. ..... 283/901

FOREIGN PATENT DOCUMENTS

| | | | | |
|---|---|---|---|---|
| DE | 37 21 651 A1 | | 1/1989 | |
| EP | 0413442 A1 | * | 7/1990 | ..... B41M/1/42 |
| EP | 0 413 442 A1 | | 2/1991 | |
| JP | 079029 | | 4/1985 | |
| JP | 1237-680 A | | 10/1986 | |
| JP | 61-237680 | | 10/1986 | |
| WO | WO 99/18163 | | 4/1999 | |

* cited by examiner

*Primary Examiner*—John Barlow
*Assistant Examiner*—Manish S. Shah
(74) *Attorney, Agent, or Firm*—Fay, Sharpe, Fagan, Minnich & McKee, LLP

(57) ABSTRACT

Description of a method for printing non-porous surfaces of a substrate with a solvent-containing inkjet ink. Said method is characterized in that a non-porous, varnish-coated surface is printed with an inkjet ink containing a varnish-etching component. High resolution and excellent smudge and scratch resistance can hereby be attained. Beneficial three-color print is possible.

15 Claims, No Drawings

METHOD FOR PRINTING ON NON-POROUS SURFACES

The invention relates to a method for printing with an inkjet ink on on-porous surfaces of a substrate.

Until now, inket inks were printed directly onto materials or substrates having a non-porous surface. The inkjet inks may contain components which produce or improve adhesion to these surfaces. JP-A-078472 describes a transparent receiver medium which has an imprintable transparent coating. The transparent receiver medium is characterized by light permeability in the visible range of more than 80%. A method for producing water-proof markings on surfaces of plastic materials is disclosed in WO 99/18163. An ink is hereby utilized which contains a not easily volatilized solvent, which is absorbed, to a large extent, by the plastic material. In DE-A-3721651, a method is proposed for printing on plate-shaped information carriers with label information. The method is characterized in essence in that the label information is furnished by means of a data processing system. EP-A-413442 describes an ink for the marking of plastic material, whose composition comprises an organic solvent. The employed solvent leads to separation or swelling of the plastic material to be printed.

In the known proposals, adhesion continues to be unsatisfactory. In addition, so-called massive outflow leads to low resolution, with long drying times. lnkjet inks with brief drying times lead to clogging of the print head jets. Colored or black surfaces cannot be printed according to the traditional three-color-print, since white as a mixed color is missing on the substrate. At the present time there is no satisfactory solution for a white inkjet ink. Currently, no useable technical proposal exists in order to remedy these problems. The invention was therefore based on the object of improving the initially mentioned method in such fashion that it is possible to imprint non-porous surfaces of any type of substrate, specifically of plastic, metal, glass and ceramic and similar, with an inkjet ink, while achieving, for the ink, brief drying times, good adhesion and resistance to water. In addition, high resolution is to be sought. The disadvantageous bleeding of the ink on the non-porous surface of the substrate shall be excluded to a large extent.

The present invention solves this object in that the non-porous surface, coated with a varnish, is printed with an inkjet ink containing a varnish-etching component. The nature of the invention, consequently, consists in providing the non-porous surface of the substrate with a varnish layer. The type of varnish does not play a decisive role. Instead, one only needs to pay attention to the fact that between the respectively employed varnish and the inkjet ink employed for printing there is coordination to the extent that in the inkjet ink there is contained a component which etches or swells the varnish on the non-porous surface of the substrate. Generally, this is the solvent of the inkjet ink proper. Additionally, it is also conceivable that an additional component is contained in the inkjet ink which causes the etching or swelling of the varnish coating. This may involve, for example, alcohols, glycol-esters, esters, ketones or chlorated hydro-carbons.

In the individual case it is necessary to add to the varnish pigments and/or coloring substances, in order to achieve the desired color shade. In such instance, one also speaks of varnish paints (compare DIN 55 945, December 1988). Basically, varnishes are liquid or powdery solid substances, which are applied in thin layer on articles or which form a solid film adhering to the objects by chemical reaction and/or physical modification, said film having a decorative and/or protective function. The main components of the varnish are binders, solvents, pigments, fillers and varnish auxiliaries. In case of non-covering clear varnish, whose color depends upon that of the binder, the pigment is omitted, in case of solid varnish in powder form, the solvent is omitted. According to DIN 55 945 (December 1988) varnishes are coating substances based on organic binders. Depending upon the type of organic binder, varnishes may contain organic solvents, and/or water or contain neither. According to the meaning of the invention, included in varnishes are also "colored varnishes" which originate from so-called lacquerification. Varnish-hardening plays hereby a role. The hardening into stable surfaces of varnishes applied in liquid state is called varnish-hardening. Varnish-hardening can take place either by air drying (physical drying), by oxidative cross-linkage (atmospheric moisture hardening) or—as in the case of the hardening of plastic—by polymerization (unsaturated polyesters/polystyrols), poly-addition (polyisocyanate/polyhydroxy-compounds or poly-epoxide/polyamine) or by poly-condensation (alkyd or acrylate resins with amine resins). As binders in varnishes are mostly used refined natural products, for example made of colophonium and oil or cellulose nitrate (nitro-varnishes) and totally synthetically constructed resins, (artificial resins). The classic natural resins, such as cupale, amber and shellac have currently only little technical application significance.

Employed as synthetic resins are specifically phenol resins, amine resins (for example benzo-guanamine-, urea-, melamine-resins), alkyd-resins, polyvinylacetate, epoxide resins, polyurethane-resins, polyester-resins, with colophonium-modified phenol-resins, chlorinated rubber, chlorinated polypropylene, cyclo-rubber, ketone resins, acrylate resins. Solvents or thinners in applicable resins according to the invention are liquids in which binders are dissolved in order to bring varnishes into a better applicable form. During drying the of varnish coating, these solvents almost fully evaporate, with the varnish remaining behind as film, either cross-linked or not-cross-linked, with glossy, matte or satiny appearance. Being considered as solvents are, in particular, ether-alcohols, aromatics, chlorated hydrocarbons, esters, hydro-aromatics, ketones, terpene hydrocarbons, andwater among others. Generally, several of these solvents are combined.

As already states, these varnishes can be pigmented, i.e. they can be mixed with the traditional solvents, insolvable organic or inorganic pigments, for example titanium dioxide, ferrous oxide red, ferrous oxide black, chromium oxide green, molybdate, cadmium pigments, carbon blacks, azo-, phthalocyanine, triarylmethane pigments etc. (compare Roempp Chemical Lexicon, 9th Edition, Vo. 3,1990 pages 1414/1425.

From what has been stated above it becomes evident that the invention-specific vamish-coated substrate is not transparent. The varnish-coated substrate preferably presents a permeability to light in the visible range of less than approximately 80%, specifically of less than approximately 50%. In a particularly preferred specific embodiment, the varnish-coated substrate is characterized by light permeability of less than approximately 10%; specifically it is light-impermeable.

Preferred within the scope of the invention are specifically acrylic varnishes based on acrylic resins, (compare Roempp Chemical Lexicon, 9th Edition, Volume 1, 1989, page 41). They are applied in many ways in form of solutions in organic solvents, as watery dispersions or as powdery varnishes. To that end, glycolether is a particular suitable and preferred solvent. The following description of the invention is based on the use of a varnish in form of an acrylic resin varnish or an acrylic varnish. As is readily apparent to the person skilled in the art, the determinations made here, correspondingly apply as well with respect to the other previously identified varnish systems if the invention-specific concept is kept in mind of coordination between the varnish and the etching or swelling component of the ink-jet ink. If a colored or black, non-porous surface of a substrate is to be printed for purposes of identification, decoration or similar, then it is of particular benefit to use an acrylic varnish. This acrylic varnish is applied as solution in an organic solvent, as watery dispersion or a powdery varnish and subsequently dried or, after melting, permitted to again cool down. Application is effected in particular by spraying or coating until the non-porous surface to be coated is fully covered. In each instance followed by drying, which causes, on the one hand, the removal of the solvent or dispersing agent, and/or the drying at high temperature after melting of the powdery varnish with subsequent cool-down.

For purposes of the present invention, the thickness of the respectively applied varnish layer is not essential. In general, the varnish layer on the non-porous surface should have a thickness of approximately 1 to approximately 500 $\mu$m, specifically approximately 5 to 100 $\mu$m.

For purposes of the invention, an inkjet ink has proven itself as particularly suitable which starts to etch or swell specifically with use of an acrylic varnish, which produces good fixation of coloring substance on the substrate surface and which prevents flowing of the inkjet ink.

The varnish layer withdraws from the ink a part of the solvent and thus reduces the drying time. The thereby attained resolution is clearly higher that with printing of the free [uncoated] substrate surface. The type of substrate does not play a significant role. In the end, the only decisive criterion is that the varnish has adequate adhesion on the substrate, which is generally the case. This involves, in particular, substrates of glass, metal, ceramics, plastics and similar. Preferred among the synthetic substances are polystyrol (PS), polyvinyl -chloride (PVC), acryl-nitril-butadiene-styrol copolymerisate (ABS) and polypropylene. Of particular benefit is the invention-specific concept if a non-porous surface of a substrate is printed according to the conventional three color print. With three-color print via inkjet technology, extremely small ink droplets of the basic colors yellow, cyan and magenta are placed next to each other on the substrate, so that, combined with the white background, the impression is created of a mixed color. One speaks here of subtractive color mixing. High quality prints are only possible if bleeding of the ink droplets into each other is prevented, particularly at adjacent color surfaces. The smaller the droplets and the distance between same, the greater the resolution of the print. The invention-specific method provides the required white background and prevents the intermixing of neighboring ink droplets.

The benefits attainable with the invention can be recorded as follows: high resolution after printing, extremely good resistance to smudging and scratching, specifically due to application of white varnish on colored or black substrate for development of color imprints according to the traditional 3-color print. These benefits largely outweigh the disadvantage that an additional production step is needed in realizing the present invention, namely applying the varnish on the non-porous surface of the substrate.

The invention is explained in more detail below making use of an example:

EXAMPLE

A black substrate of polystyrol was sprayed with a white acrylic varnish containing titanium dioxide as white pigment, n-butanol and acetone as solvents (Dupli Color Auto Acryl Spray Classic, 0–75) and dried at room temperature, so that a sealed varnish layer was formed. After drying, printing was effected with black inkjet ink by means of a Codent Printer with a 200 dpi MIT print head (Piezo Technology, 128 jets). For preparation of the employed inkjet ink, a concentrated formulation relating to the pigment was first ground on an agitator ball mill and subsequently thinned out to the following composition (in mass-%):

5% black beads 880 (by Cabot Corporation) 2% Mowital B-20H (Polyvinylbutyral by Clariant) 31% Dowanol PnP (Propylenclykol-monopropyl-ether by Dow Chemical) 59% Dowanol PnB (Propyleneglycol-monobutyl-ether by Dow Chemical) 3% Beckopox-EM460 (by Vianova Resins).

One recognizes that the droplets do not completely flow into another, but that each individual drop is still recognizable.

The white areas in the center of the ink drops originate with the drying process. Their development can be prevented by slight increase in the drying time.

COMPARATIVE EXAMPLE

Example 1 was repeated with the same ink, but printed on an uncoated ABS (Acrylonitril-butadiene-styrol)-substrate. Although this kind of substrate is still relatively well suited, since its surface is also slightly etched by the glyco ethers contained in the inkjet ink, the droplets run into each other to a much greater extent. A multi-color print in which adjacent drops must not run into each other is not possible in this fashion.

What is claimed is:

1. Method for printing non-porous surfaces of a substrate with a solvent-containing inkjet ink comprising the steps of: applying a varnish as a solution in an organic solvent, a watery dispersion, or powder solvent onto a non-porous surface until said non-porous surface is fully covered; drying said varnish onto said non-porous surface; and printing on said varnish-coated non-porous surface with an inkjet ink containing a varnish-etching component.

2. Method according to claim 1, characterized in that an acrylic varnish is selected as varnish.

3. Method according to claim 1, characterized in that a colored or black, non-porous, surface, coated with white acrylic varnish, is printed.

4. Method according to claim 1, characterized in that a glycol-ether is contained as solvent in the inkjet ink.

5. Method according to claim 1, characterized in that the substrate consists of glass, metal, ceramics or synthetic material.

6. Method according to claim 5, characterized in that the synthetic material is present in form of polystyrol, polyvinylchloride, polypropylene and acryl-nitrile-butadiene-styrol co-polymerisate.

7. Method according to claim 1, characterized in that the varnish layer on the non-porous surface has a thickness of approximately 1 to approximately 500 $\mu$m.

8. Method according to claim 1, characterized in that the varnish-coated, non-porous surface is printed according to the traditional three-color print.

9. Method for printing non-porous surfaces of substrate with a solvent-containing inkjet comprising the steps of: applying a varnish onto a non-porous surface until said non-porous surface is covered; drying said varnish onto said non-porous surface; and printing on said varnish-coated non-porous surface with an inkjet ink containing a varnish-etching component.

10. Method according to claim 9, wherein an acrylic varnish is selected as said varnish.

11. Method according to claim 9, further comprising the step of applying said varnish as a solution in an organic solvent, as a water dispersion, or as powdery varnish.

12. Method according to claim 9, said step of applying includes applying a white acrylic varnish onto a colored or black non-porous surface.

13. Method for printing non-porous surfaces of substrate with a solvent-containing inkjet comprising the steps of: applying varnish as solution in an organic solvent, as watery dispersion or as powdery varnish onto a non-porous surface; and printing on said varnish-coated non-porous surface with an inkjet ink containing a varnish-etching component.

14. Method according to claim 13, wherein said varnish is an acrylic varnish.

15. Method according to claim 13, said step of applying includes applying a white acrylic varnish onto a colored or black non-porous surface.

* * * * *